US009396683B2

(12) United States Patent
Tseng et al.

(10) Patent No.: US 9,396,683 B2
(45) Date of Patent: Jul. 19, 2016

(54) PIXEL DRIVING CIRCUIT AND DISPLAY DEVICE

(71) Applicant: EverDisplay Optronics (Shanghai) Limited, Shanghai (CN)

(72) Inventors: Ying-Hsiang Tseng, Shanghai (CN); Ching-hung Lee, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 0 days.

(21) Appl. No.: 14/463,305

(22) Filed: Aug. 19, 2014

(65) Prior Publication Data

US 2015/0109277 A1 Apr. 23, 2015

(30) Foreign Application Priority Data

Oct. 21, 2013 (CN) ..... 2013 1 0496478

(51) Int. Cl.
*G09G 3/32* (2016.01)

(52) U.S. Cl.
CPC ..... *G09G 3/3266* (2013.01); *G09G 3/3233* (2013.01); *G09G 3/3291* (2013.01); *G09G 2300/0819* (2013.01); *G09G 2300/0842* (2013.01); *G09G 2300/0861* (2013.01); *G09G 2320/0238* (2013.01); *G09G 2320/043* (2013.01)

(58) Field of Classification Search
CPC . G09G 3/3208; G09G 3/3233; G09G 3/3266; G09G 2300/0408; G09G 2300/0426; G09G 3/3225; G09G 3/3648; G09G 2300/0819; G09G 2300/0842; G09G 2300/0861; G09G 2320/043; G09G 3/3291; H05B 33/0845; Y02B 20/36
USPC ..... 345/36, 39, 45–46, 76–82; 315/169.3
See application file for complete search history.

(56) References Cited

U.S. PATENT DOCUMENTS

2005/0243036 A1* 11/2005 Ikeda ..... 345/76
2010/0141644 A1* 6/2010 Lee et al. ..... 345/214
2014/0166351 A1* 6/2014 Lee et al. ..... 174/258
2014/0168180 A1* 6/2014 Kim ..... 345/205

FOREIGN PATENT DOCUMENTS

JP 2005326828 A 11/2005
JP 2007225738 A 9/2007

OTHER PUBLICATIONS

Office Action issued Oct. 6, 2015 by the JP Office.

* cited by examiner

*Primary Examiner* — Hong Zhou
(74) *Attorney, Agent, or Firm* — Yunling Ren; Eaton & Van Winkle

(57) ABSTRACT

The present disclosure provides a pixel driving circuit and a display device, the pixel driving circuit includes: a control unit; a capacitor; a first transistor; a second transistor; a third transistor and a fourth transistor. The present disclosure can effectively compensate the variation of the threshold voltage of the drive thin film transistor by controlling the thin film transistors, thus prevent nonuniform brightness of a screen due to nonuniform current, and extend lifespan of the screen.

18 Claims, 7 Drawing Sheets

PIXEL DRIVING CIRCUIT AND DISPLAY DEVICE

CROSS-REFERENCE TO RELATED APPLICATIONS

The present application is based on and claims priority to Chinese patent application No. 201310496478.3, filed on Oct. 21, 2013, the whole contents of which are incorporated herein by reference.

TECHNICAL FIELD

The present disclosure relates to a display device, and more particularly to a driving circuit of the display device.

BACKGROUND

The organic light emitting display devices have the property of self-luminescence, and adopt very thin coatings of organic material and glass substrates. The organic material may emit light when current passes therethrough. Moreover, the organic light emitting display devices have display screens with large angle of visibility and can evidently save electric energy, therefore the organic light emitting display devices have superiority over many liquid crystal display devices.

The organic light emitting display devices may be classified into passive matrix types and active matrix types. In the organic light emitting display devices of passive matrix types, pixels are arranged in the matrix form at positions where scan lines and signal lines intersect each other; and in the organic light emitting display devices of active matrix types, each pixel is controlled by a thin film transistor operating as a switch.

FIG. 1 is a circuit diagram showing a pixel circuit of a conventional organic light emitting display device.

Referring to FIG. 1, the pixel circuit of the conventional organic light emitting display device includes a plurality of scan lines G1 to Gn extending in the same direction, a plurality of data lines S1 to Sm extending in the same direction, a plurality of common power lines D1 to Dm extending in the same direction and a plurality of pixel units 101. The number of the data lines is equal to the number of the common power lines. The plurality of data lines S1 to Sm and the plurality of scan line G1 to Gn intersect and are insulated from each other. The plurality of common power lines D1 to Dm and the plurality of scan line G1 to Gn intersect and are insulated from each other. Each pixel unit 101 is defined by a region surrounded by the scan lines, the data line and the common power line.

The circuit diagram of the pixel unit 101 is shown in FIG. 2. Each pixel unit 101 includes a switching thin film transistor 108, a drive thin film transistor 112, a capacitor 110 and an organic light emitting diode 114. One pixel unit 101 is defined by a region surrounded by the scan lines 102, the data line 104 and the common power line 106.

The organic light emitting diode 114 includes a pixel electrode, an organic emitting layer formed on the pixel electrode, and a common electrode formed on the organic emitting layer. The pixel electrode functions as an anode of a hole injecting electrode, and the common electrode functions as a cathode of an electron injecting electrode. In one modification, according to the driving method of the organic light emitting display device, the pixel electrode may be the cathode, and the common electrode may be the anode. Holes and electrons are injected to the organic emitting layer respectively from the pixel electrode and the common electrode to form excitons. When the exciton is changed from an excited state to a ground state, it may emit light.

The switching thin film transistor 108 includes a switching semiconductor layer (not shown in the drawings), a switching gate electrode 107, a switching source electrode 103 and a switching drain electrode 105. The drive thin film transistor 112 includes a driving semiconductor layer (not shown in the drawings), a driving gate electrode 115, a driving source electrode 113 and a driving drain electrode 117.

The capacitor 110 includes a first sustaining electrode 109 and a second sustaining electrode 111, with an interlayer insulating layer interposed between the first sustaining electrode 109 and the second sustaining electrode 111.

The switching thin film transistor 108 functions as a switch for selecting pixels to emit light. The switching gate electrode 107 is connected to the scan line 102. The switching source electrode 103 is connected to the data line 104. The switching drain electrode 105 is provided to be separated from the switching source electrode 103 by a certain distance. The switching drain electrode 105 is connected to the first sustaining electrode 109.

The drive thin film transistor 112 applies drive power to the pixel electrode, such that the organic emitting layer of the organic light emitting diode 114 of the selected pixel emits light. The driving gate electrode 115 is connected to the first sustaining electrode. The driving source electrode 113 and the second sustaining electrode 111 are respectively connected to the common power line 106. The driving drain electrode 117 is connected to the pixel electrode of the organic light emitting diode 114 through a contact hole.

With the above-described structure, the switching thin film transistor 108 is driven by the gate voltage applied to the scan line 102, such that the data voltage applied to the data line 104 is transmitted to the drive thin film transistor 112. A voltage corresponding to a voltage difference between the common voltage transmitted to the drive thin film transistor 112 from the common power line 106 and the data voltage transmitted by the switching thin film transistor 108 is stored in the capacitor 110, and a current corresponding to the voltage stored in the capacitor 110 flows to the organic light emitting diode 114 through the drive thin film transistor 112, thereby the organic light emitting diode 114 emits light.

Further, the voltage source of the organic light emitting display device is a main cause of brightness, therefore the stability of the voltage source is an important index for properties of the organic light emitting display device.

The organic light emitting display devices with high resolutions have become the inevitable trend at present. However, panels with high resolutions have the problems that the charging time becomes short and the number of the data lines increases. Both of the problems may cause the voltage source of the organic light emitting display device to be disturbed and thus can not restore the initial stable potential.

Specifically, in the active matrix organic light emitting display device, brightness is determined by a current passing through the organic light emitting diode. In order to maintain the brightness of the organic light emitting display device to be uniform, the current of the organic light emitting diode needs to be controlled within a range of ±1%. However, the conventional IC circuits all transmit voltage signals instead of current signals, therefore it is difficult for the pixels in the active matrix organic light emitting display devices to accomplish transferring the voltage signals into the current signals within one frame period while keeping respective pixels stable and uniform. The threshold voltage of the drive thin film transistor in the organic light emitting diode drive circuit is one of the important factors for the current.

SUMMARY

To solve the above problems, in one aspect, the present disclosure provides a pixel driving circuit, including: a control unit being coupled with a data line, a common power line, a first scan line and a first node, and controlling a voltage of the first node to be a voltage on the data line or a voltage on the common power line by an input signal from the first scan line; a capacitor having a first sustaining electrode coupled with the first node, and a second sustaining electrode coupled with a second node; a first transistor having a source coupled with the common power line, a gate coupled with the second scan line, and a drain; a second transistor having a source coupled with a third node, a gate coupled with the second node, and a drain coupled with the drain of the first transistor; a third transistor having a source coupled with the third node, a gate coupled with a first input terminal, and a drain coupled with the second node; and a fourth transistor having a source coupled with the third node, a gate coupled with a second input terminal, and a drain coupled with an anode of a light emitting diode.

In one embodiment, the first input terminal may be configured to receive a reference signal, and the second input terminal is configured to receive a light emitting signal.

In another embodiment, the control unit may include: a fifth transistor having a source coupled with the data line, a gate coupled with the first scan line, and a drain coupled with the first node; and a sixth transistor having a source coupled with the first node, a gate coupled with the first scan line, and a drain coupled with the common power line.

In further another embodiment, the fifth transistor may have a PMOS structure; and the sixth transistor may have a NMOS structure, in the case that a high level voltage is applied to the first scan line, the fifth transistor is turned off, the sixth transistor is turned on, and a voltage on the common power line is applied to the first node; and in the case that a low level voltage is applied to the first scan line, the fifth transistor is turned on, the sixth transistor is turned off, and a voltage on the data line is applied to the first node.

In still another embodiment, the first transistor may have a NMOS structure; and the second transistor, the third transistor and the fourth transistor may have PMOS structures.

In still further another embodiment, the first transistor, the second transistor, the third transistor, the fourth transistor, the fifth transistor and the sixth transistor may be one of: polysilicon thin film transistors; or amorphous silicon thin film transistors.

In still further another embodiment, the fifth transistor may have a NMOS structure; and the sixth transistor may have a PMOS structure, in the case that a high level voltage is applied to the first scan line, the fifth transistor is turned on, the sixth transistor is turned off, and a voltage on the data line is applied to the first node; and in the case that a low level voltage is applied to the first scan line, the fifth transistor is turned off, the sixth transistor is turned on, and a voltage on the common power line is applied to the first node.

In still further another embodiment, the first transistor, the second transistor, the third transistor and the fourth transistor may have PMOS structures.

In still further another embodiment, the first transistor, the second transistor, the third transistor, the fourth transistor, the fifth transistor and the sixth transistor may be one of: polysilicon thin film transistors; or amorphous silicon thin film transistors.

In still further another embodiment, the capacitor may be a ceramic capacitor.

In another aspect, the present disclosure provides a display device, which includes a plurality of scan lines, common power lines intersecting and being insulated from the plurality of scan lines, data lines intersecting and being insulated from the plurality of scan lines, and a plurality of pixel units defined by regions surrounded by the plurality of scan lines, the data lines and the common power lines, wherein the pixel unit includes: a light emitting diode; and a pixel driving circuit including: a control unit being coupled with the data lines, the common power lines, a first scan line and a first node, and controlling a voltage of the first node to be a voltage on the data line or a voltage on the common power line by an input signal from the first scan line; a capacitor having a first sustaining electrode coupled with the first node and a second sustaining electrode coupled with a second node; a first transistor having a source coupled with the common power line, a gate coupled with a second scan line, and a drain; a second transistor having a source coupled with a third node, a gate coupled with the second node, and a drain coupled with the drain of the first transistor; a third transistor having a source coupled with the third node, a gate coupled with a first input terminal, and a drain coupled with the second node; and a fourth transistor having a source coupled with the third node, a gate coupled with a second input terminal, and a drain coupled with an anode of the light emitting diode, wherein the first scan line coupled with the pixel driving circuit is the second scan line of a pixel driving circuit adjacent to the pixel driving circuit.

In one embodiment, the first input terminal may be configured to receive a reference signal, and the second input terminal may be configured to receive a light emitting signal.

In another embodiment, the control unit may include: a fifth transistor having a source coupled with the data line, a gate coupled with the first scan line, and a drain coupled with the first node; and a sixth transistor having a source coupled with the first node, a gate coupled with the first scan line, and a drain coupled with the common power line.

In further another embodiment, the fifth transistor may have a PMOS structure; and the sixth transistor may have a NMOS structure, in the case that a high level voltage is applied to the first scan line, the fifth transistor is turned off, the sixth transistor is turned on, and a voltage on the common power line is applied to the first node; and in the case that a low level voltage is applied to the first scan line, the fifth transistor is turned on, the sixth transistor is turned off, and a voltage on the data line is applied to the first node.

In still another embodiment, the first transistor may have a NMOS structure; and the second transistor, the third transistor and the fourth transistor may have PMOS structures.

In still further another embodiment, the first transistor, the second transistor, the third transistor, the fourth transistor, the fifth transistor and the sixth transistor may be one of: polysilicon thin film transistors; or amorphous silicon thin film transistors.

In still further another embodiment, the fifth transistor may have a NMOS structure; and the sixth transistor may have a PMOS structure, in the case that a high level voltage is applied to the first scan line, the fifth transistor is turned on, the sixth transistor is turned off, and a voltage on the data line is applied to the first node; and in the case that a low level voltage is applied to the first scan line, the fifth transistor is turned on, the sixth transistor is turned off, and a voltage on the common power line is applied to the first node.

In still further another embodiment, the first transistor, the second transistor, the third transistor and the fourth transistor may have PMOS structures.

In still further another embodiment, the first transistor, the second transistor, the third transistor, the fourth transistor, the fifth transistor and the sixth transistor may be one of: polysilicon thin film transistors; or amorphous silicon thin film transistors.

In still further another embodiment, the light emitting diode may be an organic light emitting diode.

The present disclosure may effectively compensate the variations of the threshold voltage of the drive thin film transistor through controlling the plurality of thin film transistors by using the pixel unit including the plurality of thin film transistors and one capacitor as well as the scan line, the reference signal and the light emitting signal, thus prevent nonuniform brightness of a screen due to nonuniform current, and extend lifespan of the screen.

BRIEF DESCRIPTION OF THE DRAWINGS

The above and other features and advantages of the present disclosure will become apparent from the following description of the exemplary embodiments given in conjunction with the accompanying drawings.

REFERENCE SIGNS

Figure 1:
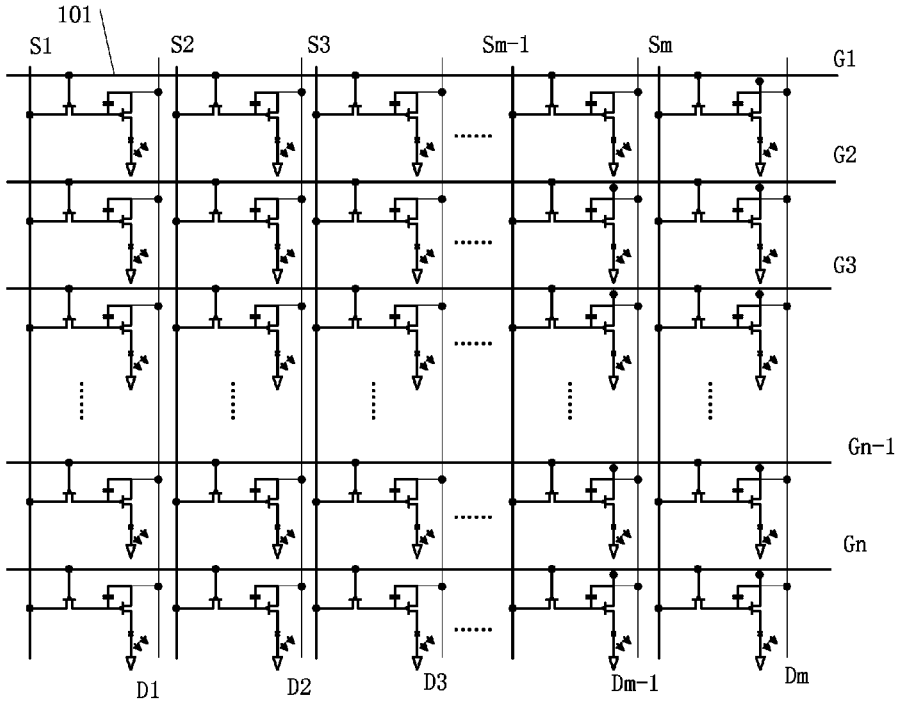
FIG. 1 is an illustrative circuit diagram showing a pixel driving circuit of an organic light emitting display device in the related art.
Figure 2:
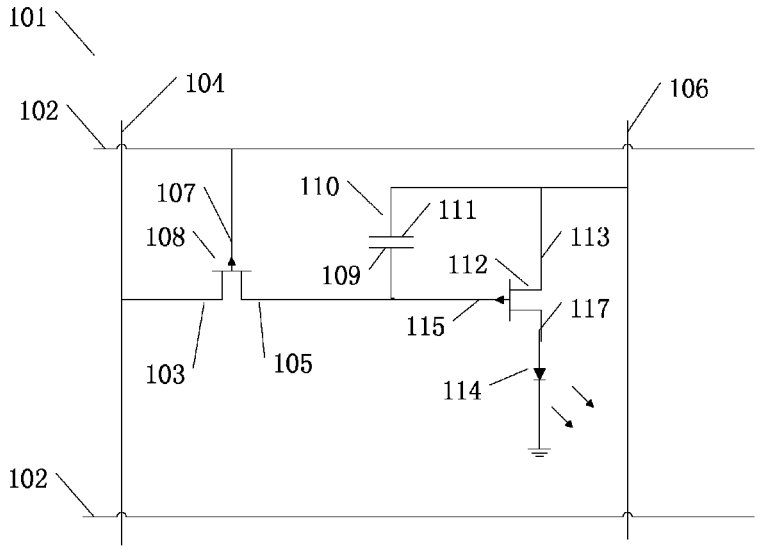
FIG. 2 is an illustrative circuit diagram showing each pixel unit in the pixel driving circuit of the organic light emitting display device in the related art.

101 pixel unit
102 scan line
104 data line
106 common power line
108 switching thin film transistor
103 source of the switching thin film transistor
105 drain of the switching thin film transistor
107 gate of the switching thin film transistor
110 capacitor
109 first sustaining electrode
111 second sustaining electrode
112 drive thin film transistor
113 source of the drive thin film transistor
117 drain of the drive thin film transistor
115 gate of the drive thin film transistor
114 light emitting diode
200, 300 pixel unit
202, 302 common power line
204, 304 data line
206, 306 first scan line
208, 308 second scan line
210, 310 first input terminal
212, 312 second input terminal
214, 314 control unit
220, 320 first node
222, 322 second node
236 third node
228, 328 first transistor
226, 326 second transistor
224, 324 third transistor
230, 330 fourth transistor
216, 316 fifth transistor
218, 318 sixth transistor
234, 334 capacitor
232, 332 light emitting diode
238, 338 ground
402, 602 first portion of the signal waveform diagram
404, 604 second portion of the signal waveform diagram
406, 606 third portion of the signal waveform diagram
10 pixel unit
20 scan driver
30 data driver
40 light emitting (reference) signal driver

DETAILED DESCRIPTION

The illustrative embodiments will be described more thoroughly with reference to the following drawings. However, the illustrative embodiments may be implemented in many ways, and should not be interpreted as to be limited by the embodiments described herein. On the contrary, those embodiments are provided for illustrating the present disclosure thoroughly and completely, and for illustrating the concept of the illustrative embodiments to those skilled in the art. In the drawings, the thickness of areas and layers may be exaggerated for the purpose of clarity. Like reference signs in the drawings will represent the same or like structures, and the detailed descriptions of which will be omitted.

Figure 3:
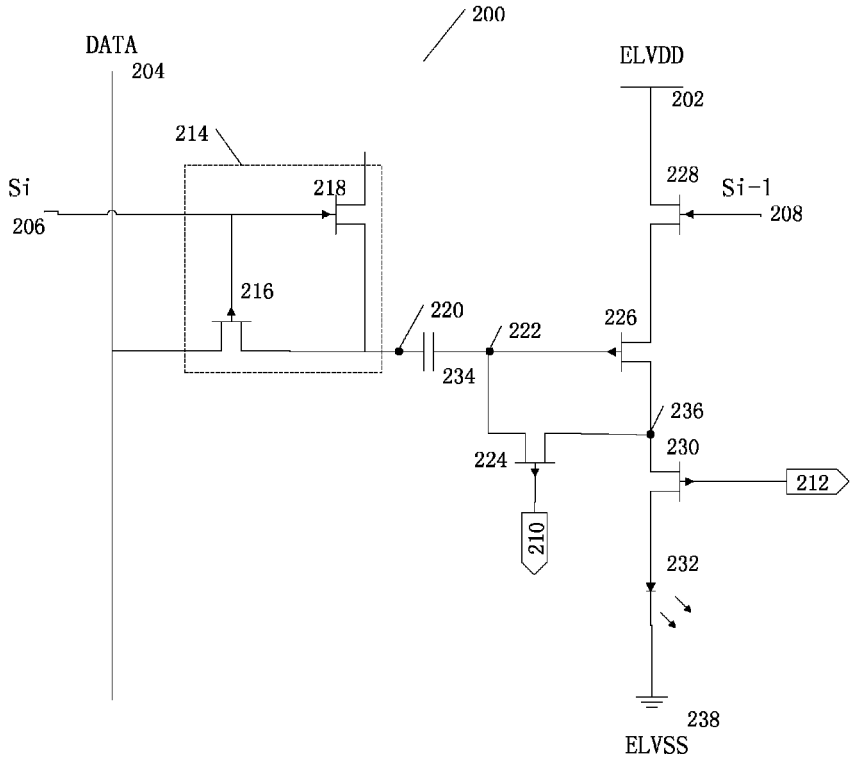
FIG. 3 is an illustrative circuit diagram showing each pixel unit in a pixel driving circuit of an organic light emitting display device according to a first embodiment of the present disclosure.

FIG. 3 is an illustrative circuit diagram showing each pixel unit in a pixel driving circuit of an organic light emitting display device according to a first embodiment of the present disclosure. The pixel unit 200 includes a control unit 214, a capacitor 234, a first transistor 228, a second transistor 226, a third transistor 224, a fourth transistor 230 and a light emitting diode 232.

The control unit 214 is coupled with a data line 204, a common power line 202, a first scan line 206 and a first node 220. Specifically, the control unit 214 includes a fifth transistor 216 and a sixth transistor 218. The fifth transistor 216 has a source coupled with the data line 204, a gate coupled with the first scan line 206, and a drain coupled with the first node 220. The sixth transistor 218 has a source coupled with the first node 220, a gate coupled with the first scan line 206, and a drain coupled with the common power line 202. In the present embodiment, the fifth transistor 216 has a PMOS structure, and the sixth transistor 218 has a NMOS structure.

The capacitor 234 is provided with a first sustaining electrode coupled with the first node 220 and a second sustaining electrode coupled with a second node 222.

The first transistor 228 is provided with a source, a gate and a drain. The source of the first transistor 228 is coupled with the common power line 202, the gate of the first transistor 228 is coupled with the second scan line 208, and the drain of the first transistor 228 is coupled with the drain of the second transistor 226. In the present embodiment, the first transistor 228 has a NMOS structure.

The second transistor 226 is provided with a source, a gate and a drain. The source of the second transistor 226 is coupled with a third node 236, the gate of the second transistor 226 is coupled with the second node 222, and the drain of the second transistor 226 is coupled with the drain of the first transistor 228. In the present embodiment, the second transistor 226 has a PMOS structure.

The third transistor 224 is provided with a source, a gate and a drain. The source of the third transistor 224 is coupled with the third node 236, the gate of the third transistor 224 is coupled with a first input terminal 210, and the drain of the third transistor 224 is coupled with the second node 222. The first input terminal 210 is configured to receive a reference signal. In the present embodiment, the third transistor 224 has a PMOS structure.

The fourth transistor 230 is provided with a source, a gate and a drain. The source of the fourth transistor 230 is coupled with the third node 236, the gate of the fourth transistor 230 is coupled with a second input terminal 212, and the drain of the fourth transistor 230 is coupled with an anode of the light emitting diode 232. In the present embodiment, the fourth transistor 230 has a PMOS structure.

The anode of the light emitting diode 232 is coupled with the drain of the fourth transistor 230, and a cathode of the light emitting diode 232 is grounded. Preferably, the light emitting diode 232 is an organic light emitting diode.

Each transistor in the present embodiment may be a polysilicon thin film transistor or an amorphous silicon thin film transistor.

The second transistor 226 is a drive transistor for the pixel unit. In the present embodiment, a voltage between two ends of the capacitor 234 is controlled by a light emitting signal, the reference signal and a scan signal. Further, the current passing through the light emitting diode is not affected by a threshold voltage of the drive transistor.

Specifically, the control unit 214 controls a voltage of the first node 220 to be a voltage of the data line 204 or a voltage of the common power line 202 by an input signal from the first scan line 206. Since the fifth transistor 216 has a PMOS structure, the sixth transistor 218 has a NMOS structure, when a high level voltage is applied to the first scan line 206, the fifth transistor 216 is turned off, the sixth transistor 218 is turned on, and the voltage on the common power line 202 is applied to the first node 220; and when a low level voltage is applied to the first scan line 206, the fifth transistor 216 is turned on, the sixth transistor 218 is turned off, and the voltage on the data line 204 is applied to the first node 220. The input signal from the second scan line 208 and the reference signal from the first input terminal 210 are used to control the voltage applied to the second node 222.

Figure 4:
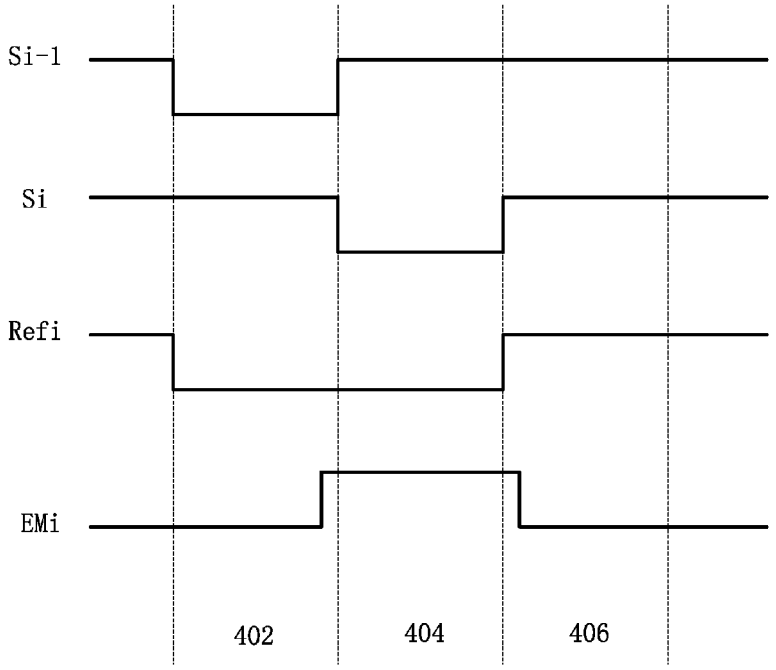
FIG. 4 is a waveform diagram showing input signals of the pixel driving circuit of the organic light emitting display device according to the first embodiment of the present disclosure.

Further, the operation states of respective transistors in the pixel unit will be described with reference to the waveform diagram in FIG. 4 which shows input signals of the pixel driving circuit of the organic light emitting display device according to the first embodiment of the present disclosure.

In the present embodiment, the variation of each signal within one frame period is divided into three portions.

In the first portion 402, the pixel unit is initialized.

A high level voltage is applied to the first scan line Si, the fifth transistor is turned off, the sixth transistor is turned on, and the voltage $V_{ELVDD}$ on the common power line is applied to the first node, i.e., the first sustaining electrode of the capacitor.

A low level voltage is applied to the second scan line Si-1, and the first transistor is turned off. A low level voltage is applied to the reference signal Refi, and the third transistor is turned on. A low level voltage is applied to the light emitting signal Emi, and the fourth transistor is turned on. The voltage of the second node 222 is equivalent to a voltage when the organic light emitting diode is turned off, i.e., the voltage of the second sustaining electrode of the capacitor is equivalent to the voltage when the organic light emitting diode is turned off.

In the second portion 404, a data signal is written into the pixel unit.

A low level voltage is applied to the first scan line Si, the fifth transistor is turned on, the sixth transistor is turned off, and the voltage $V_{DATA}$ on the data line is applied to the first node, i.e., the first sustaining electrode of the capacitor.

A high level voltage is applied to the second scan line Si-1, and the first transistor is turned on. A low level voltage is applied to the reference signal Refi, and the third transistor is turned on. A high level voltage is applied to the light emitting signal Emi, and the fourth transistor is turned off. The voltage of the second node is the voltage on the common power line being subtracted by a threshold voltage of the second transistor, i.e., $V_{ELVDD}-V_{th}$. That is, the voltage of the second sustaining electrode of the capacitor is $V_{ELVDD}-V_{th}$, wherein $V_{th}$ is the threshold voltage of the second transistor.

In the third portion 406, the pixel unit is controlled to emit light.

A high level voltage is applied to the first scan line Si, the fifth transistor is turned off, and the sixth transistor is turned on. The voltage of the first node is changed from $V_{DATA}$ to $V_{ELVDD}$. That is, the voltage of the first sustaining electrode of the capacitor is changed from $V_{DATA}$ to $V_{ELVDD}$.

A high level voltage is applied to the second scan line Si-1, and the first transistor is turned on. A high level voltage is applied to the reference signal Refi, and the third transistor is turned off. A low level voltage is applied to the light emitting signal Emi, and the fourth transistor is turned on. The second transistor is turned on. The voltage of the second node is $V_{ELVDD}-V_{th}-(V_{DATA}-V_{ELVDD})$. That is, the voltage of the first sustaining electrode of the capacitor is $V_{ELVDD}-V_{th}-(V_{DATA}-V_{ELVDD})$.

The current passing through the light emitting diode can be calculated by the following formula:

$$I_{OLED}=\beta*(V_{SG}-V_{th})^2,$$

wherein, $I_{OLED}$ is the current passing through the light emitting diode, $\beta=\frac{1}{2}\mu CoxW/L$, $V_{SG}$ is a voltage difference between the source and the drain of the second transistor, and $V_{SG}=V_{th}+(V_{DATA}-V_{ELVDD})$, $V_{th}$ is a threshold voltage of the second transistor.

From above, the following formula can be obtained by introducing the equation of $V_{SG}$ into the above formula:

$$I_{OLED}=\beta*(V_{DATA}-V_{ELVDD})^2.$$

According to the above formula, the current passing through the light emitting diode is not affected by the threshold voltage of the drive transistor.

Figure 5:
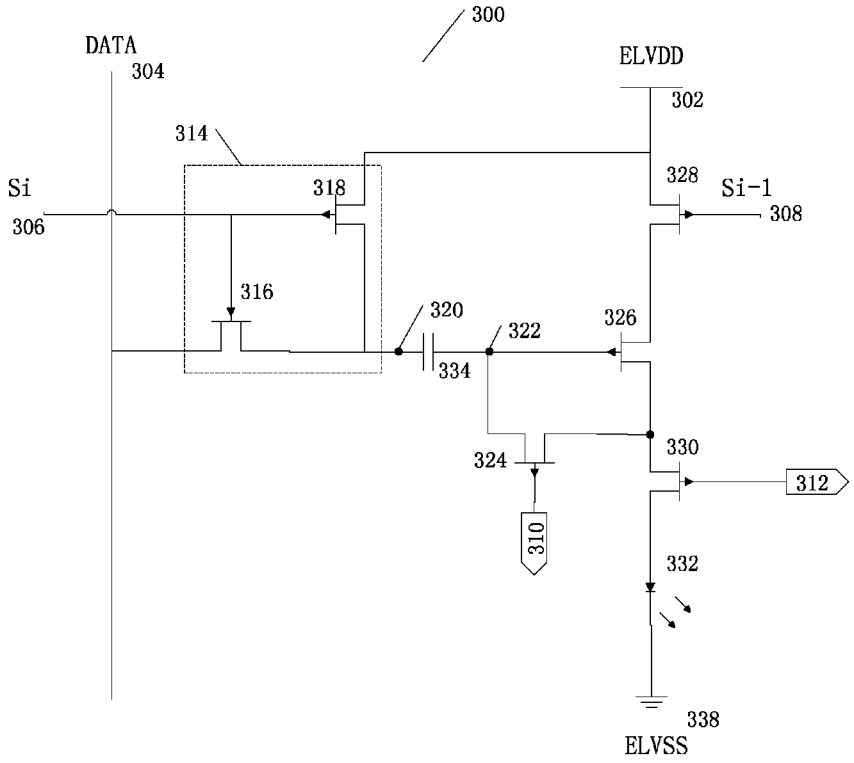
FIG. 5 is an illustrative circuit diagram showing each pixel unit in a pixel driving circuit of an organic light emitting display device according to a second embodiment of the present disclosure.

FIG. 5 is an illustrative circuit diagram showing each pixel unit in a pixel driving circuit of an organic light emitting display device according to a second embodiment of the present disclosure. Similar to the first embodiment shown in FIG. 3, the pixel unit 300 includes a control unit 314, a capacitor 334, a first transistor 328, a second transistor 326, a third transistor 324, a fourth transistor 330 and a light emitting diode 332. The control unit 314 includes a fifth transistor 316 and a sixth transistor 318. The connection relationships among respective elements thereof are the same as those of the first embodiment shown in FIG. 3. Specifically, in the present embodiment, the first transistor 328, the second transistor 326, the third transistor 324, the fourth transistor 330 and the sixth transistor 318 have PMOS structures, and the fifth transistor 316 has a NMOS structure. Preferably, the light emitting diode 332 is an organic light emitting diode.

In the present embodiment, each transistor may be a polysilicon thin film transistor or an amorphous silicon thin film transistor.

The second transistor 326 is a drive transistor for the pixel unit. In the present embodiment, the voltage (i.e., the voltage between two ends of the capacitor 334) applied to the first node 320 and the second node 322 by the data line 304, the common power line 302 and the ground 338 is controlled by a light emitting signal (from a second input terminal 312), a reference signal (a first input terminal 310) and signals on the first scan line 306 and the second scan line 308. In this way, the current passing through the light emitting diode is not affected by the threshold voltage of the drive transistor.

Specifically, the control unit 314 controls a voltage of the first node 320 to be a voltage of the data line 304 or a voltage of the common power line 302 by the input signal from the first scan line 306. Since the fifth transistor 316 has a NMOS structure, the sixth transistor 318 has a PMOS structure, when a high level voltage is applied to the first scan line 306, the fifth transistor 316 is turned on, the sixth transistor 318 is turned off, and the voltage on the data line 304 is applied to the first node 320; and when a low level voltage is applied to the first scan line 306, the fifth transistor 316 is turned off, the sixth transistor 318 is turned on, and the voltage on the common power line 302 is applied to the first node 320. The input signal of from second scan line 308 and the reference signal from the first input terminal 310 control the voltage applied to the second node 322.

Figure 6:
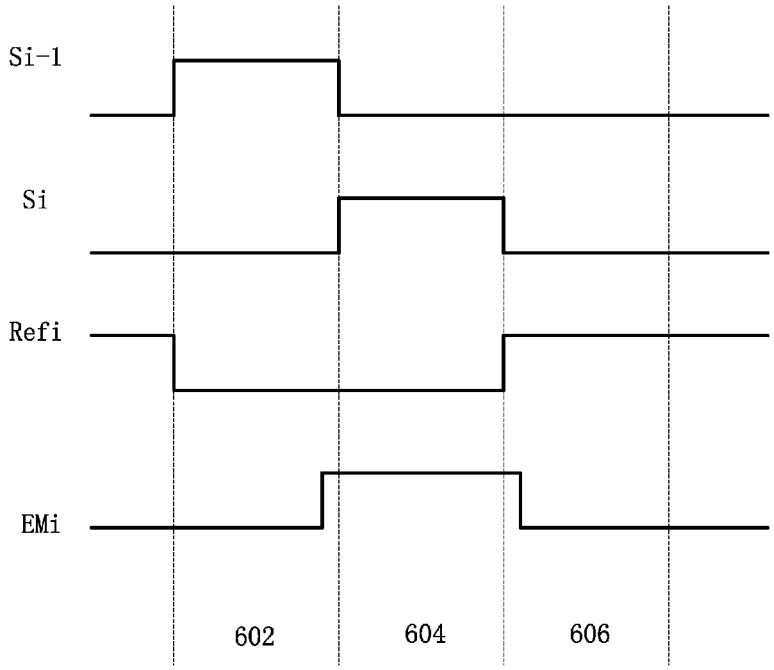
FIG. 6 is a waveform diagram showing input signals of the pixel driving circuit of the organic light emitting display device according to the second embodiment of the present disclosure.

Further, the operation states of respective transistors in the pixel unit will be described with reference to the waveform diagram in FIG. 6 which shows input signals of the pixel circuit of the organic light emitting display device according to the second embodiment of the present disclosure.

In the present embodiment, the variation of each signal within one frame period is divided into three portions.

In the first portion 602, the pixel unit is initialized.

A low level voltage is applied to the first scan line Si, the fifth transistor is turned off, the sixth transistor is turned on, and the voltage $V_{ELVDD}$ on the common power line is applied to the first node, i.e., a first sustaining electrode of the capacitor.

A high level voltage is applied to the second scan line Si-1, and the first transistor is turned off. A low level voltage is applied to the reference signal Refi, and the third transistor is turned on. A low level voltage is applied to the light emitting signal Emi, and the fourth transistor is turned on. The voltage of the second node 322 is equivalent to a voltage when the organic light emitting diode is turned off, i.e., a voltage of the second sustaining electrode of the capacitor is equivalent to the voltage when the organic light emitting diode is turned off.

In the second portion 604, the data signal is written into the pixel unit.

A high level voltage is applied to the first scan line Si, the fifth transistor is turned on, the sixth transistor is turned off, and the voltage $V_{DATA}$ on the data line is applied to the first node, i.e., the first sustaining electrode of the capacitor.

A low level voltage is applied to the second scan line Si-1, and the first transistor is turned on. A low level voltage is applied to the reference signal Refi, and the third transistor is turned on. A high level voltage is applied to the light emitting signal Emi, and the fourth transistor is turned off. The voltage of the second node is the voltage of the common power line being subtracted by a threshold voltage of the second transistor, i.e., $V_{ELVDD}-V_{th}$. That is, the voltage of the second sustaining electrode of the capacitor is $V_{ELVDD}-V_{th}$, wherein $V_{th}$ is the threshold voltage of the second transistor.

In the third portion 606, the pixel unit is controlled to emit light.

A low level voltage is applied to the first scan line Si, the fifth transistor is turned off, and the sixth transistor is turned on. The voltage of the first node is changed from $V_{DATA}$ to $V_{ELVDD}$. That is, the voltage of the first sustaining electrode of the capacitor is changed from $V_{DATA}$ to $V_{ELVDD}$.

A low level voltage is applied to the second scan line Si-1, and the first transistor is turned on. A high level voltage is applied to the reference signal Refi, and the third transistor is turned off. A low level voltage is applied to the light emitting signal Emi, and the fourth transistor is turned on. The second transistor is turned on. The voltage of the second node is $V_{ELVDD}-V_{th}-(V_{DATA}-V_{ELVDD})$. That is, the voltage of the second sustaining electrode of the capacitor is $V_{ELVDD}-V_{th}-(V_{DATA}-V_{ELVDD})$.

The current passing through the light emitting diode can be calculated by the following formula:

$$I_{OLED}=\beta*(V_{SG}-V_{th})^2,$$

wherein, $I_{OLED}$ is the current passing through the light emitting diode, $\beta=\frac{1}{2}\mu CoxW/L$, $V_{SG}$ is a voltage difference between the source and the drain of the second transistor, and $V_{SG}=V_{th}+(V_{DATA}-V_{ELVDD})$, $V_{th}$ is a threshold voltage of the second transistor.

From above, the following formula can be obtained by introducing the equation of $V_{SG}$ into the above formula:

$$I_{OLED}=\beta*(V_{DATA}-V_{ELVDD})^2.$$

According to the above formula, the current passing through the light emitting diode is not affected by the threshold voltage of the drive transistor.

Figure 7:
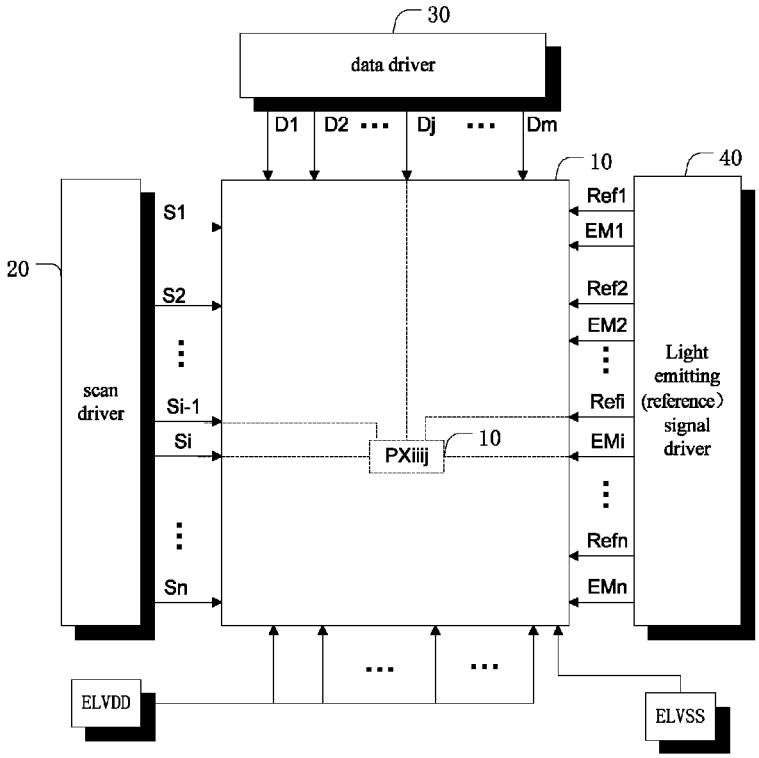
FIG. 7 is a schematic diagram showing the organic light emitting display device provided by the present disclosure.

FIG. 7 is a schematic diagram showing the organic light emitting display device provided by the present disclosure. The display device includes a plurality of scan lines S1 to Sn, common power lines intersecting and being insulated from the scan lines and providing a voltage ELVDD, data lines D1 to Dm intersecting and being insulated from the scan lines, a plurality of pixel units 10 defined by regions surrounded by the plurality of scan lines, the data lines and the common power lines. The scan signals on the scan lines S1 to Sn are controlled by the scan driver 20. The data signals on the data lines D1 to Dm are controlled by the data driver. The present embodiment also shows a light emitting (feedback) signal control driver which is configured to provide corresponding light emitting control signals and feedback signals to respective pixel units 10.

The pixel unit PXiiij (the iiij$^{th}$ pixel unit 10) receives signals from two scan lines Si and Si-1, a feedback signal Refi, a light emitting control signal Emi, and a signal from the data line Dj, and is connected with two potentials ELVDD and ELVSS.

The circuit of each pixel unit 10 is shown in FIG. 3 of the first embodiment or in FIG. 5 of the second embodiment. The waveforms of the signals from the scan lines Si and Si-1, the feedback signal Refi and the light emitting control signal Emi are respectively shown in FIG. 4 of the first embodiment or in FIG. 6 of the second embodiment.

The organic light emitting display device provided by the present disclosure can effectively compensate the variations of the threshold voltage of the drive thin film transistor, thus prevent nonuniform brightness of a screen due to nonuniform current, and extend lifespan of the screen.

The illustrative embodiments have been described in detail as above. It should be understood that the present disclosure is not restricted by those disclosed embodiments, but intends to cover various modifications and equivalent arrangements within the spirit and scope of the appended claims.

What is claimed is:

1. A pixel driving circuit, comprising:

a control unit being coupled with a data line, a common power line, a first scan line and a first node, and controlling a voltage of the first node to be a voltage on the data line or a voltage on the common power line by an input scan signal from the first scan line;

a capacitor having a first sustaining electrode coupled with the first node and a second sustaining electrode coupled with a second node;

a first transistor having a source coupled with the common power line, a gate coupled with a second scan line, and a drain;

a second transistor having a source coupled with a third node, a gate coupled with the second node, and a drain coupled with the drain of the first transistor;

a third transistor having a source coupled with the third node, a gate coupled with a first input terminal for receiving a reference signal, and a drain coupled with the second node; and a fourth transistor having a source coupled with the third node, a gate coupled with a second input terminal for receiving a light emitting signal, and a drain coupled with an anode of a light emitting diode, wherein the scan signal is controlled by a scan driver, the reference signal is driven by a reference signal driver, and a voltage between two ends of the capacitor is controlled by the light emitting signal, the reference signal and the scan signal.

2. The pixel driving circuit according to claim 1, wherein the control unit comprises:

a fifth transistor having a source coupled with the data line, a gate coupled with the first scan line, and a drain coupled with the first node; and a sixth transistor having a source coupled with the first node, a gate coupled with the first scan line, and a drain coupled with the common power line.

3. The pixel driving circuit according to claim 2, wherein the fifth transistor has a PMOS structure; and the sixth transistor has a NMOS structure, in the case that a high level voltage is applied to the first scan line, the fifth transistor is turned off, the sixth transistor is turned on, and a voltage on the common power line is applied to the first node; and in the case that a low level voltage is applied to the first scan line, the fifth transistor is turned on, the sixth transistor is turned off, and a voltage on the data line is applied to the first node.

4. The pixel driving circuit according to claim 3, wherein the first transistor has a NMOS structure; and the second transistor, the third transistor and the fourth transistor have PMOS structures.

5. The pixel driving circuit according to claim 4, wherein the first transistor, the second transistor, the third transistor, the fourth transistor, the fifth transistor and the sixth transistor are one of:

polysilicon thin film transistors; or amorphous silicon thin film transistors.

6. The pixel driving circuit according to claim 2, wherein the fifth transistor has a NMOS structure; and the sixth transistor has a PMOS structure, in the case that a high level voltage is applied to the first scan line, the fifth transistor is turned on, the sixth transistor is turned off, and a voltage on the data line is applied to the first node; and in the case that a low level voltage is applied to the first scan line, the fifth transistor is turned off, the sixth transistor is turned on, and a voltage on the common power line is applied to the first node.

7. The pixel driving circuit according to claim 6, wherein the first transistor, the second transistor, the third transistor and the fourth transistor have PMOS structures.

8. The pixel driving circuit according to claim 7, wherein the first transistor, the second transistor, the third transistor, the fourth transistor, the fifth transistor and the sixth transistor are one of:

polysilicon thin film transistors; or amorphous silicon thin film transistors.

9. The pixel driving circuit according to claim 1, wherein the capacitor is a ceramic capacitor.

10. A display device, comprising a plurality of scan lines, a plurality of common power lines, a plurality of data lines, and a plurality of pixel units, said plurality of common power lines and said plurality of data lines intersect and are insulated from said plurality of scan lines, said plurality of pixel units are defined by regions surrounded by said plurality of scan lines, said plurality of data lines and said plurality of common power lines, wherein the pixel unit comprises:

a light emitting diode; and a pixel driving circuit, comprising:

a control unit being coupled with the data line, the common power line, a first scan line and a first node, and controlling a voltage of the first node to be a voltage of the data line or a voltage of the common power line by an input scan signal from the first scan line;

a capacitor having a first sustaining electrode coupled with the first node and a second sustaining electrode coupled with a second node;

a first transistor having a source coupled with the common power line, a gate coupled with a second scan line, and a drain;

a second transistor having a source coupled with a third node, a gate coupled with the second node, and a drain coupled with the drain of the first transistor;

a third transistor having a source coupled with the third node, a gate coupled with a first input terminal for receiving a reference signal, and a drain coupled with the second node; and a fourth transistor having a source coupled with the third node, a gate coupled with a second input terminal for receiving a light emitting signal, and a drain coupled with an anode of the light emitting diode, wherein the first scan line coupled with the pixel driving circuit is the second scan line of a pixel driving circuit adjacent to the pixel driving circuit, wherein the scan signal is controlled by a scan driver, the reference signal is driven by a reference signal driver, and a voltage between two ends of the capacitor is controlled by the light emitting signal, the reference signal and the scan signal.

11. The display device according to claim 10, wherein the control unit comprises:

a fifth transistor having a source coupled with the data line, a gate coupled with the first scan line, and a drain coupled with the first node; and a sixth transistor having a source coupled with the first node, a gate coupled with the first scan line, and a drain coupled with the common power line.

12. The display device according to claim 11, wherein the fifth transistor has a PMOS structure; and the sixth transistor has a NMOS structure, in the case that a high level voltage is applied to the first scan line, the fifth transistor is turned off, the sixth transistor is turned on, and a voltage on the common power line is applied to the first node; and in the case that a low level voltage is applied to the first scan line, the fifth transistor is turned on, the sixth transistor is turned off, and a voltage on the data line is applied to the first node.

13. The display device according to claim 12, wherein the first transistor has a NMOS structure; and the second transistor, the third transistor and the fourth transistor have PMOS structures.

14. The display device according to claim 13, wherein the first transistor, the second transistor, the third transistor, the fourth transistor, the fifth transistor and the sixth transistor are one of:

polysilicon thin film transistors; or amorphous silicon thin film transistors.

15. The display device according to claim 11, wherein the fifth transistor has a NMOS structure; and the sixth transistor has a PMOS structure, in the case that a high level voltage is applied to the first scan line, the fifth transistor is turned on, the sixth transistor is turned off, and a voltage on the data line is applied to the first node; and in the case that a low level voltage is applied to the first scan line, the fifth transistor is turned off, the sixth transistor is turned on, and a voltage on the common power line is applied to the first node.

16. The display device according to claim 15, wherein the first transistor, the second transistor, the third transistor and the fourth transistor have PMOS structures.

17. The display device according to claim 16, wherein the first transistor, the second transistor, the third transistor, the fourth transistor, the fifth transistor and the sixth transistor are one of:

polysilicon thin film transistors; or amorphous silicon thin film transistors.

18. The display device according to claim 10, wherein the light emitting diode is an organic light emitting diode.

* * * * *